US005634521A

United States Patent [19]

Roeder

[11] Patent Number: 5,634,521

[45] Date of Patent: Jun. 3, 1997

[54] VALVE ASSEMBLY FOR DOWNHOLE HYDRAULICALLY ACTUATED PUMP

[76] Inventor: George K. Roeder, Box 807, Big Sandy, Tex. 75755

[21] Appl. No.: 518,531

[22] Filed: Aug. 23, 1995

[51] Int. Cl.[6] ..... E21B 43/00

[52] U.S. Cl. ..... 166/370; 166/105.2; 417/402

[58] Field of Search ..... 166/106, 68.5, 166/105.6, 105.2, 370; 417/403, 404, 401, 264, 402

[56] References Cited

U.S. PATENT DOCUMENTS

| | | | |
|---|---|---|---|
| 2,081,223 | 5/1937 | Coberly | 103/46 |
| 3,703,926 | 11/1972 | Roeder | 166/106 |
| 3,849,030 | 11/1974 | McAuthur et al. | 417/393 |
| 4,080,111 | 3/1978 | Roeder | 417/393 |
| 4,118,154 | 10/1978 | Roeder | 417/402 |
| 4,214,854 | 7/1980 | Roeder | 417/402 |
| 4,477,234 | 10/1984 | Roeder | 417/393 |
| 4,544,335 | 10/1985 | Roeder | 417/401 |
| 5,104,296 | 4/1992 | Roeder | 417/403 |
| 5,494,102 | 2/1996 | Schulte | 166/105.6 |

*Primary Examiner*—Frank Tsay

*Attorney, Agent, or Firm*—George K. Roeder

[57] ABSTRACT

In a new valve assembly, the coacting abutting surfaces are imperfect due to normal fabrication techniques, and leakage occurs across these surfaces, which allows the control valve assembly to operate for a limited time while the engine parts are new, but continual engagement of the confronting top end of the control valve and stop member eventually become worn and firmly seats the control valve against its stop, and thus leakage across the control valve and stop member is precluded due to this progressive wear, whereupon the engine control valve will remain seated against its respective stop member and operation of the pump assembly is terminated until the malfunction is corrected. Premature stoppage, or stalling, of the top end of the main valve of a hydraulically actuated engine for downhole pumps is overcome in the present apparatus, and this feature is useful in many prior art pump assemblies. The present disclosure further enables a control rod of a hydraulically actuated engine for downhole pumps to be made much larger in diameter, making it possible to increase the operating speed of the coacting parts as well as the rate of produced fluid/per stroke, all of which represents unexpected improvements in operation of both the engine end as well as the pump end of the pump assembly.

19 Claims, 6 Drawing Sheets

VALVE ASSEMBLY FOR DOWNHOLE HYDRAULICALLY ACTUATED PUMP

BACKGROUND OF THE DISCLOSURE

This invention relates to hydraulically actuated pumps and particularly to subsurface oil well pumps of the type having a hydraulically actuated engine connected to reciprocate a downhole pump. More specifically, this invention comprehends improvements in hydraulically actuated engines for downhole pumps and in particular to an improved control valve assembly which controls the flow of power fluid to an engine piston thereof which in turn is connected to reciprocate a pump piston of a downhole pump to which the engine may be attached. This invention provides a new, improved valve assembly for a hydraulically actuated engine of a downhole pump assembly, and is particularly adapted for use in the type of pump disclosed in several prior art patents such as U.S. Pat. No. 3,703,926, for example.

An important benefit that is derived by combining my new improved engine with various prior art production pumps is that the valve rod or control valve can be made much larger in diameter thereby making it possible to increase the operating speed as well as the rate of produced fluid/per stroke, all of which represents unexpected improvements in operation of both the engine end as well as the pump end of the pump assembly. Those skilled in the art, having fully digested this entire disclosure, will appreciate that my improved hydraulic engine can advantageously be incorporated into and combined with numerous downhole pump ends other than the specific examples cited herein.

Usually the entire valve assembly of a hydraulically actuated engine assembly is positioned at the uppermost end of the engine therefor, all of which is positioned at the uppermost end of the downhole pump assembly. Accordingly the term "downhole pump assembly" means an engine end and a pump end with the engine end having a valve assembly connected to supply power fluid to the engine piston in such a manner that the engine piston strokes or reciprocates a connecting rod connected to a pump piston of a downhole pump.

The valve assembly of the engine end is housed within a main body thereof within which there is mounted a fixed annular member having an axial bore through which there reciprocatingly extends a control rod. The upper end of the control rod is hollow and extends above the engine piston to which it is directly connected. The engine and pump pistons are interconnected by a connecting rod.

The engine piston has power fluid passageways formed therein and connected to the hollow control rod for power fluid being received under the engine piston and thereby cyclicly forcing the piston to reciprocate upwards. A control sleeve is fixed within the main body of the engine, with an annulus provided between the control sleeve and the fixed annular liner member for reciprocatingly receiving the annular engine control valve therein.

Those skilled in the art will appreciate that the configuration of the engine valve, control sleeve, fixed annular member, and control rod are of a design to control the flow of fluid to and from the engine piston so that the control rod strokes up and down in response to the reciprocation of the engine piston, or vice versa, as will be better appreciated later on as this disclosure is more fully digested. In a single action pump, the hydrostatic head of the fluid produced by the pump end can be utilized to force the engine piston back down.

In some types of hydraulically actuated downhole pump engines, after the pump assembly has been in operation for some time, the pump assembly will stop, with both pistons (engine and pump) remaining in the uphole position and nothing, up until this invention, cures this malfunction other than pulling the pump assembly from the well bore and replacing the worn parts. This heretofore unexplained malfunction is especially prevelent in engines of the type seen in the Coberly, U.S. Pat. No. 2,081,223 and McArthur, U.S. Pat. No. 3,849,030, and therefore reference is made to these two patents as being examples of prior art pump assemblies which are greatly improved by the present invention.

This type of malfunction of prior art downhole pump assemblies usually is incorrectly attributed to an unduly worn pump engine, which is true to some extent, however, the stuck or stalled engine usually is not badly worn at all, except as will be discussed hereinafter, because most of its usful life still remains and advantageously can be used when the engine valve assembly is made in accordance with this invention. Hence the useful life of these and other similiar prior art engine and pump assemblies can be greatly extended by incorporation of the present invention thereinto.

In prior art valve assemblies, such as cited herein, the top end of the control valve strikes its adjacent confronting stop member each upstroke of the pump. In some new prior art valve assemblies, these coacting abutting surfaces are imperfect due to normal fabrication techniques, and leakage will occure thereacross which allows the control valve assembly to operate while the engine parts are new, but when the top end of the control valve has become worn to a degree that firmly seats the control valve against its stop and thus leakage across the control valve and stop member is precluded due to this progressive wear, the engine control valve will remain seated agaist its respective stop member thereby bringing the operation of the pump assembly to a stop. Hence the pump assemble has become "locked up" due to the upper terminal end of the control valve and the lower terminaend of the stop member becomming a closed valve type structure which prevents fluid flow thereacross each time the control valve engages the upper stop therefor. This invention teaches means by which this malfunction is obviated by the provision of a flow path that extends from the interior of the control valve to the exterior thereof whereby the pressure differential across the control valve is returned to a value that sustains continuous operation of the engine assembly.

This phenomna is particularly evident in prior art engines, such as the Coberly pump, cited above, because there is a micro thread formed on the control valve by the parting tool used during the manufacturing process, and during initial operation of the engine this imperfection allows high pressure power fluid flow across the interface at the top end of the control valve and its stop member. During this initial running operation, the control valve repeatedly pounds the top control valve stop each stroke of the pump assembly, until the micro threads are polished or abraded away, and, when they are gone, a positive seal is formed at the polished ends of the control valve and its confronting stop member.

This inadvertent formation of a valve and seat from coacting parts that never were intended to be a valve device reduces the available downward force on the control valve because the net area of the main valve's upper end (see 65, FIG. 14 of the Cobely U.S. Pat. No. 2,081,223 and 35 of FIG. 2 of the McArthur U.S. Pat. No. 3,849,030) no longer is subjected to the force of the power fluid. Accordingly, the engine stalls, or ceases operation, and must be removed from the borehole and repaired which is a costly undertaking, especially in view of the pump assembly being relatively new with a long operating life left were it not for the intervening malfunction that is brought about for the reasons cited above.

Applicant has discovered that this malfunction can be avoided by modification of the control valve of a hydraulically actuated engine in accordance with this disclosure.

SUMMARY OF THE INVENTION

This invention relates to hydraulically actuated downhole pump assemblies and particularly to sub-surface oilwell pump assemblies of the type having a hydraulically actuated engine connected to reciprocate a pump. More specifically, this invention comprehends improvements in hydraulically actuated engines for downhole pumps, and in particular to an improved control valve assembly which controls the flow of power fluid to an engine piston which in turn reciprocates a pump piston of a downhole pump. This concept provides a new valve assembly for an engine, and is particularly adapted for use in the type of pump assembly disclosed in U.S. Pat. No. 3,703,926, for example.

By combining my new improved engine with various prior art production pumps, several unexpected advantages are derived, including the control valve being made much larger in diameter thereby making it possible to increase the operating speed as well as the rate of produced fluid/per stroke, all of which represents unexpected improvements in operation of both the engine end as well as the pump end of the pump assembly. More importantly, the useful life of many prior art pump assemblies is greatly elongated by the present invention which avoids stalling of the engine due to an internal engine control valve malfunction that causes the control valve to remain in the uphole position, and nothing, up until this invention, cures this malfunction other than pulling the pump assembly and replacing the worn parts. Hence, the useful life of these and other prior art engine and pump assemblies can be greatly extended by employment of the present invention.

The improvement to the engine valve assembly as taught in this patent application overcomes premature stoppage or stalling in the operation of pump assemblies of the aforesaid type. In prior art valve assemblies, such as cited herein, the top end of the control valve element strikes its adjacent confronting stop member each upstroke of the engine and pump. In some prior art valve assemblies, these coacting abutting surfaces, when new, are imperfect due to normal fabrication techniques, and leakage will occure thereacross which allows the control valve assembly to operate while the engine parts are new, but when the top end of the control valve has become worn to a degree that firmly seats the control valve against its stop and thus leakage across the control valve and stop member is precluded due to this progressive wear, the engine control valve will remain seated against its respective stop member and operation of the pump assembly stops.

This inadvertent formation of a valve and seat from the coacting valve parts reduces the available downward force on the control valve because the net area of the control valve's upper end (see 65, FIG. 14 of U.S. Pat. No. 2,081,223 and 35 of FIG. 2 of U.S. Pat. No. 3,849,030) no longer can be subjected to the force of the power fluid. Accordingly the engine stalls, or ceases operation, and must be removed from the borehole and repaired, which is a costly undertaking, especially in view of the pump assembly being relatively new with a long operating life left were it not for the intervening malfunction that is brought about for the reasons cited above.

Applicant has discovered that this malfunction can be avoided by modification of the control valve of a hydraulically actuated engine in accordance with this disclosure by the provision of means in proximity of the upper end of the control valve by which a downhole force is effected on the control valve which is always greater than the uphole force effected thereon. This unbalanced force is acheived by forming a flow passageway adjacent the upper end of the control valve and extending the flow passageway to comunicate the interior of the control valve with the exterior thereof whereby power fluid flow occurs therebetween to thereby equalize the pressure across the upper marginal end of the control valve. This modification forces the control valve to move downhole into an alternate position of operation due to the differiential in pressure effected on opposed ends of the engine piston.

Another means by which premature stoppage of operation of the control valve can be avoided is to change the configuration of the upper marginal terminal end of the control valve by increasing the inside diameter of the face at the upper end of the control valve that strikes the upper stop member and thereby increase the exposed area at the upper end of the control valve that is subjected to power fluid when the control valve is against its upper stop member, thereby forming an unbalanced force across the the control valve that forces the control valve into the alternate position.

Therefore, this invention avoids premature stoppage of operation of a control valve by enlarging the surface area on the upper end of the control valve which is exposed to power fluid respective to the opposed end thereof and thereby unbalance the opposed forces acting on opposed ends of the control valve, thus moving the control valve downhole when the two opposing forces are unequal wherein the downhole force is the greatest of the two opposed forces.

Accordingly, a primary object of this invention is the provision of improvements in a hydraulically actuated engine of a downhole pump assembly that significiently extends its useful life.

Another object of this invention is the provision of an improved engine for use in a downhole hydraulically actuated pump assembly that provides unexpected results and extends its operational life by the provision of a new and improved control valve for the engine thereof.

Still another object of this invention is the provision of an improved engine for use in a hydraulically actuated downhole pump assembly that provides a new combination of a pump and engine, and which results in an unexpected extension in the operating life thereof by the provision of a new control valve for the engine.

A still further object of this invention is the provision of improvements in the engine end of a hydraulically actuated downhole pump assembly that avoids premature stoppage of operation of the control valve thereof by the provision of a control valve that is made much larger in diameter, thereby making it possible to increase the operating speed of the coacting parts as well as the rate of produced fluid/per stroke, all of which represents unexpected improvements in operation of both the engine end as well as the pump end of the pump assembly.

Another object of this invention is the provision of improvements in the engine of a hydraulically actuated downhole pump assembly that extends its useful life by improving the design of the control valve whereby the control valve, during operation, and while abuting the stop member, always has a downward force exerted thereon that is greater than the upward force exerted thereon, and thereby avoids locking the moving parts of the entire hydraulically actuated downhole pump assembly and extends its useful life an unexpected amount by the provision of means by which power fluid is effected on the uphole end of the control valve to provide a force which is greater than the force which moves the control valve back uphole. Thus, the control valve is forced to move downward so that the operation proceeds uninterrupted.

Still another object of this invention is the provision of improvements in the the valve assembly of a hydraulically actuated engine of a downhole pump assembly that extends its useful life by incorporating into the control valve assembly means whereby, after the uphole stroke, when the control valve is engaged with its stop, power fluid that is effected on the uphole end of the control valve will provide a downward force on the control valve which is greater than the upward force on the opposed end of the control valve to thereby force the control valve to move back downhole following each uphole stroke. Thus the engine piston must continue to reciprocate which in turn reciprocates the pump end.

These and other objects of the invention are realized by the provision of an improved valve assembly of a hydraulically actuated engine of a downhole pump assembly that extends its useful life by incorporating thereinto means in close proxmity of the upper end of the control valve and stop means therefor by which a downhole force is effected on the control valve which is greater respective to the uphole force thereon and which thereby moves the control valve downhole following each uphole stroke; whereby the downhole pump assembly will continually operate during its entire useful life.

These and other objects and advantages are achievd by increasing the area on the upper end of the control valve which is exposed to power fluid and thereby providing a downhole force which exceeds the opposed uphole force on the opposed end of the control valve.

DETAILED DESCRIPTION OF THE PREFERRED EMBODIMENTS OF THE INVENTION

Figure 1:
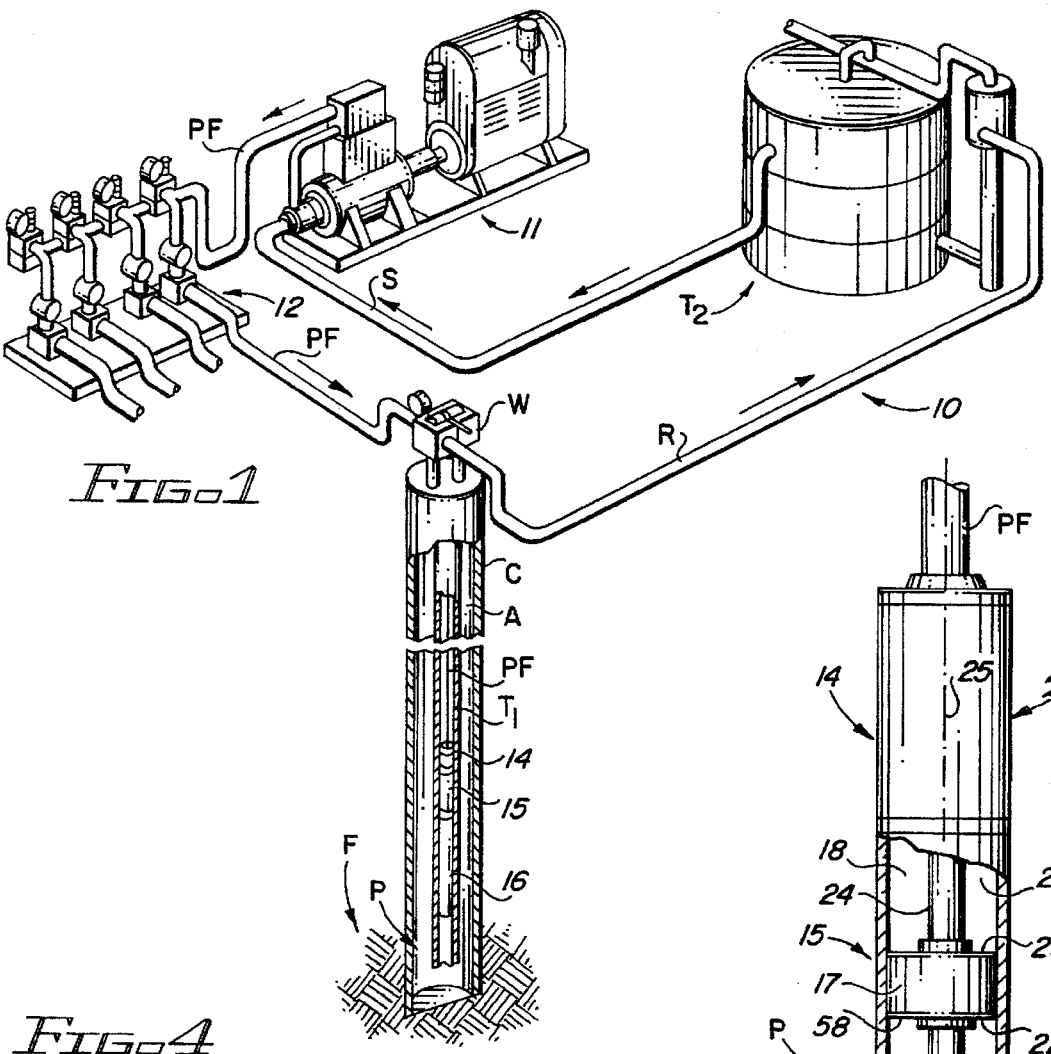
FIG. 1 of the drawings diagramatically illustrates a production system of the type that can advantageously utilize a downhole pump assembly having an engine that includes this invention.

In the various figures of the drawings, FIG. 1 diagrammatically illustrates a production system 10 for oil wells. The system 10 includes any number of wellbores W having the illustrated Christmas tree at the top end thereof. An above ground hydraulic pump and motor 11 is connected to receive hydraulic fluid from storage T2. Power fluid PF flows to valve console 12 and then to a downhole pump assembly P, which can advantageously include the present invention therein. The downhole pump assembly P produces fluid from formation F and the produced fluid, admixed with spent power fluid, flows up the production tubing T1 of the cased borehole C and through return line R and is stored as crude oil in a tank farm (not shown).

Figure 2:
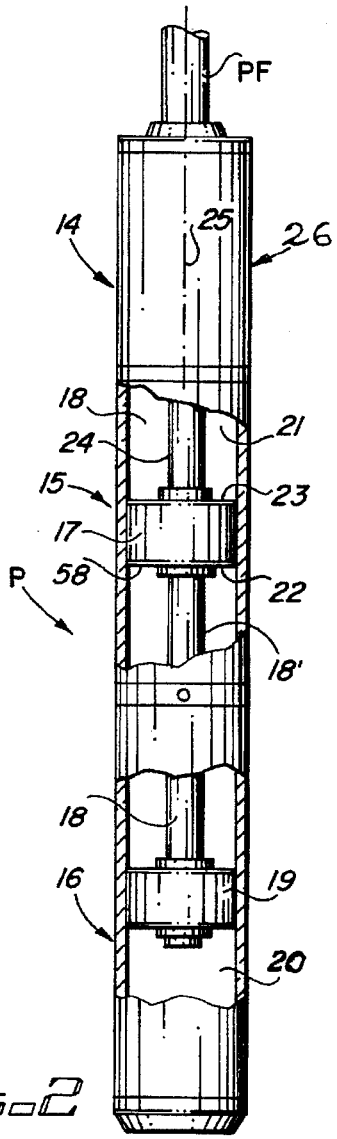
FIG. 2 is an enlarged, broken, part cross-sectional, part diagrammatical, side view of the pump assembly of FIG. 1.

The downhole pump assembly P is therefore used for producing a formation F located downhole in a borehole, and, as seen in FIG. 2, comprises an improved control valve assembly 14 that is operatively connected to a hydraulically actuated engine 15 which in turn is operatively connected to actuate a downhole pump 16 of the downhole pump assembly P.

The term "hydraulically actuated downhole pump assembly", as illustrated at P in FIGS. 1 and 2, is intended to mean a hydraulically actuated engine assembly having an upper end thereof that includes a control valve assembly 14 connected to supply power fluid to a hydraulically actuated engine 15; and, a pump end or downhole pump 16 which usually is located at the lowermost end of the pump assembly P. The control valve assembly 14 is connected to supply power fluid to the hydraulically actuated engine 15 in such a manner that the engine piston 17 strokes or reciprocates a connecting rod 18', 18 which in turn is connected to reciprocate a pump piston 19 of the pump end 16.

The pump piston 19 reciprocates within cylindrical chamber 20 while the engine piston 17 reciprocates within cylindrical chamber 21. The engine piston 17 has opposed faces 22, 23 with there being a control rod 24 affixed to face 23 of piston 17, all of which is arranged along a longitudinally extending axial centerline 25.

Figure 3:
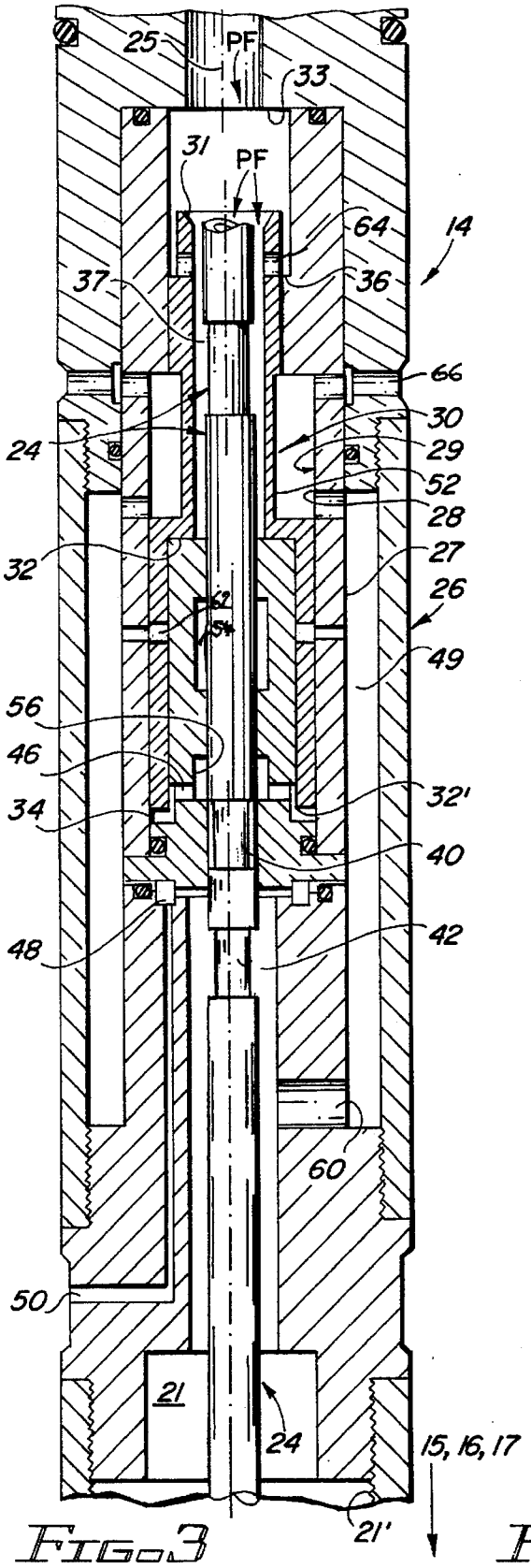
FIG. 3 is a further enlarged, broken, part cross-sectional, part diagrammatical, side view of part of FIG. 2.

In FIG. 3, the control valve assembly 14 is shown in greater detail and comprises a main body 26 within which there is mounted a fixed annular liner member 27 having an axial bore 28 through which there extends the control rod 24. The control rod 24 is hollow and can be considered an extension of the connecting rod 18, 18' that joins the engine and pump pistons together.

The engine piston 17 has power fluid passageways formed therein and connected to the hollow control rod 24 for power fluid being received under the engine piston 17 and thereby forcing the piston to reciprocate upwards. Spent power fluid below the engine piston reverses its flow by going back through the piston, valve rod, and through the valve assembly into the area above the piston. The upper chamber above the piston plus the area of the valve rod forces the power piston even though the pressure is the same.

The annulus 29 formed between the control rod 24 and the fixed annular liner member 27 reciprocatingly receives an engine control valve 30 therein. The configuration of the engine control valve, control sleeve 34, fixed annular member 27, and control rod are of a design to control the flow of fluid to and from the engine piston 17 and the control valve 30 as the control rod 24 strokes up and down in response to the reciprocation of the engine piston. The top of the control sleeve 34 acts as the downward control valve stop, as will be understood by those skilled in the art, and especially after this disclosure is more fully digested.

Figure 5A:
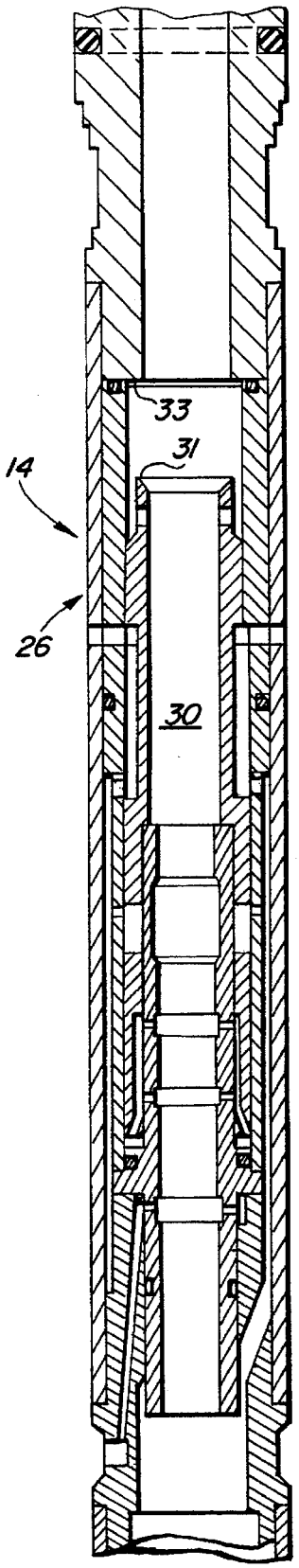
FIGS. 5A and 5B are an enlarged, broken, part cross-sectional, part diagrammatical, side views of part of the appartus of FIG. 3, showing an engine control valve thereof in alternate positions, and shown less the valve rod for better understanding.
Figure 5B:
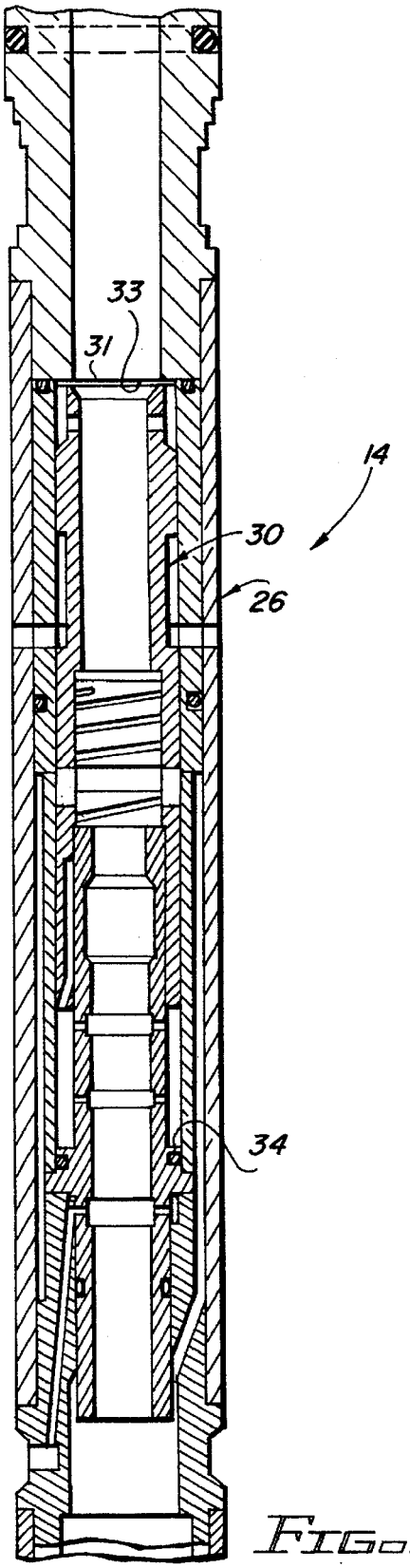

In FIGS. 5A and 5B, note that the control valve 30 is in the uppermost position (FIG. 5B) when the engine piston 17 (FIG. 2) moves down; and, the control valve 30 is in its lowermost position (FIG. 5A), when the piston 17 moves up. Hence, in FIG. 3 the control valve is down and therefore the control rod 24 and pistons 17 and 19 must move up.

In FIGS. 2 and 3, together with other figures of the drawing, the hydraulically actuated engine 15 has an axial passageway that includes cylindrical chamber 21, within which the engine piston 17 is reciprocatingly received. The control valve assembly 14 includes a control valve 30, made in accordance with this invention. The control valve 30 is reciprocatingly received within the control valve assembly 14 and forms part thereof. The control valve 30 is connected to shift into one of two alternate positions of operation in response to the change in one of two alternate positions of the control rod 24, and includes various flow passageways connected to supply power fluid to the lower face 22 of the engine piston 17 to thereby stroke the engine piston 17 uphole carrying the pump piston 19 therewith, while allowing exhausting power fluid above the engine piston out through the valve assembly.

In FIG. 3, the control valve 30 has an upper end 31 opposed to an inside shoulder 32 and a lower end 32' thereof. The upper end 31 abuttingly engages an annular face formed at the lower terminal end of an annular upper stop means 33 that is also located along centerline 25 and within part of the axial passageway. The inside shoulder 32 of the control valve 30 abutingly engages its confronting shoulder against the upper terminal end of a lower stop means or control sleeve 34 to arrest downward movement of the control valve 30.

Figure 8A:
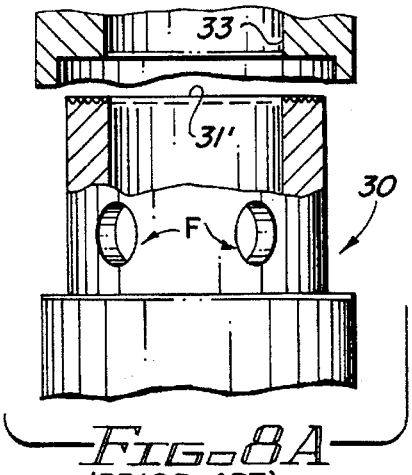
FIG. 8A (PRIOR ART)
FIG. 8A diagrammatically illustrates a feature of the prior art which causes malfunction of a valve assembly for a downhole pump engine.

In some prior art engines, during the first several hundred hours of initial operation of a new control valve assembly 14, the upper end 31 of the control valve 30 has a tiny spiral groove that was cut therein during manufacture, as seen at 35 in FIG. 8B. During operation, the continuous abuttment of the opposed confronting faces located at the terminal ends of the control valve 30 and stop means 33 eventually erode away the small imperfections 35 located on the face at upper end 31 of the control valve 30 and thereafter becomes firmly seated respective to the coacting confronting surface of the stop (see FIGS. 8A and 8B).

Hence the formation of a seal surface on the interface between the prior art control valve and the upper stop means of the hydraulically actuated engine of the downhole pump assembly acts somewhat as a valve means, noting that it precludes fluid flow across the confronting faces of the control valve and stop 30, 33 when they are moved into abutment with one another, and allow flow thereacross when moved apart. However, when the design of this particular control valve assembly fails to provide for a downward force to be exerted thereon that is greater than the upward force exerted thereon, the control valve assembly will become stalled as soon as the above seal is formed, thereby locking the moving parts of the entire hydraulically actuated downhole pump assembly, and reducing its useful production life. This malfunction is overcome by the present invention by the provision of means by which power fluid is effected on the uphole end of the control valve 30 to provide a downhole force which is greater than the force which moves the control valve back uphole. Thus the absence of grooves 35 of FIG. 8B in the present invention is of no consequence and the useful life of the entire hydraulically actuated downhole pump assembly is extended an unexpected amount by the the improvements set forth herein.

Figure 4:
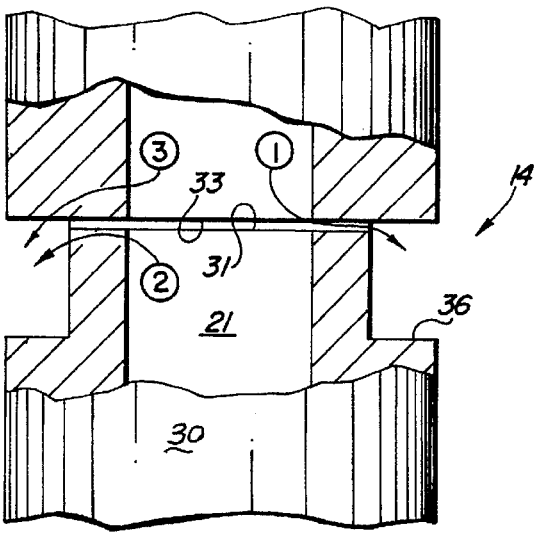
FIG. 4 is an enlarged, broken, part cross-sectional, part diagrammatical, side view of part of the above pump assembly.

As seen in various figures of the drawings, and in particular FIG. 4, equalizing means 1, 2 and 3 (see circled numerals 1, 2 and 3 of FIG. 4) is provided in close proximity of the confronting terminal ends of the coacting confronting faces of the control valve 30 and upper stop means. The equalizing means 1–3 provide for increasing the area at the upper end of the control valve against which power fluid is effected at the uphole end of the control valve to provide a downhole force which is greater than the uphole force that fluid effects on the opposed end thereof to thereby prevent the stoppage of movement of the control valve and thereby moves the control valve 30 back downhole following each uphole stroke. This is particularly seen illustrated in FIG. 4 which shows the confronting surfaces at ends 31 and 33, respectively, of the control valve 30 and stop means 33, respectively, as the control valve and stop are about to abutingly engage one another, and diagrammatically illustrates the meaning of the term "equalizing means provided in close proximity of the confronting terminal ends of the coacting confronting control valve and stop means".

Still looking at FIG. 4, together with other figures of the drawings, the arrows indicated by the circled numerals 1, 2, and 3, respectively, indicate various means at the upper end of the control valve element by which the appropriate downhole force is effected on the control valve 30. The first illustrated means 1 is a plurality of flow passageways formed at or immediately adjacent the interface of the confronting faces of the control valve 30 and stop 33. As seen in FIG. 3, the small passageways 64 extend from the interior of the control valve to the exterior 36 thereof in order to equalize the pressure across the upper end 31 of the control valve 30 and thereby expose additional surface area at the upper part of the control valve to the power fluid that is in the axial passageway. This forces the control valve to move into its alternate position of operation, that is, to stroke downhole against its lower shoulder stop 32.

Figure 11:
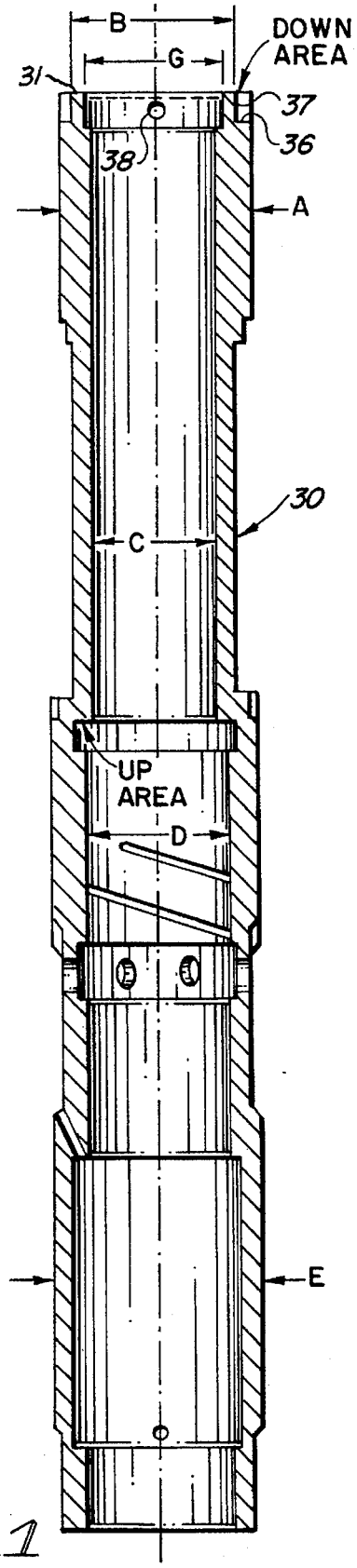
FIG. 11 is an enlarged, part cross-sectional, part diagrammatical, side view of part of the appartus of FIG. 2, showing another modification of the engine control valve thereof.

In FIG. 4, the second means 2 by which the upper end of the control valve element has a downhole force effected thereon is a flow passageway which preferably is formed through the upper marginal end portion of the control valve at a location adjacent and below the upper terminal end 31 of the control valve 30 and forming a flow path that extends from the interior to the exterior 36 of the control valve to increase the force on the upper end of the control valve element by subjecting additional area to the power fluid when the control valve is otherwise locked in the up position. This provides a resultant downhole force that is effected on the control valve 30 which is greater than the resultant uphole force. The details of the second means 2 of FIG. 4 is shown in FIG. 11 wherein there is a plurality of apertured milled slots formed circumferentially about the upper marginal end of the control valve. The small holes 38 allow equalization of the fluid pressure near the upper end of the control valve and exposes additional surface area 36 at the upper marginal end of the control valve to the power fluid by means of the small holes or passageways 38 and thereby force the control valve 30 to move into an alternate position of operation, which is downhole in this example.

Figure 9:
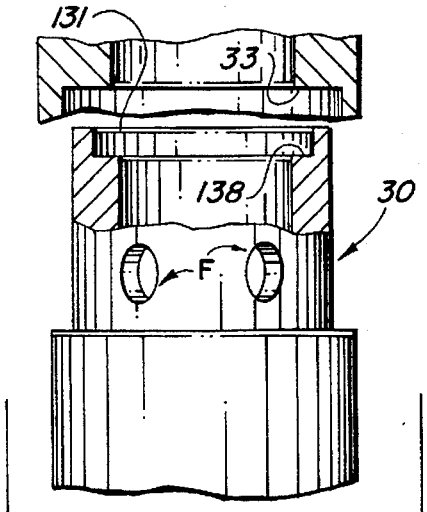
FIGS. 9 and 10 are broken, part cross-sectional, part diagrammatical, side views of various modifications of part of the apparatus of FIG. 3.
Figure 8:
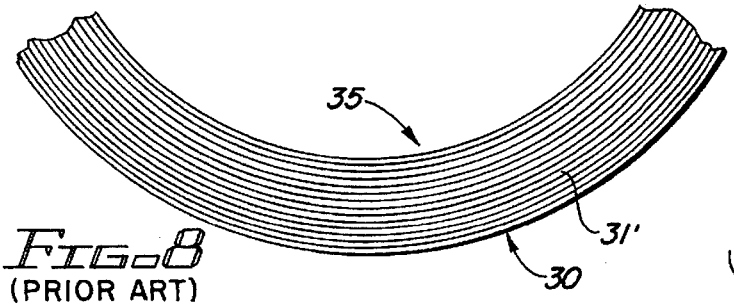
FIG. 8 (PRIOR ART)
FIG. 8B illustrates a partial top view of a prior art control valve.
Figure 10:
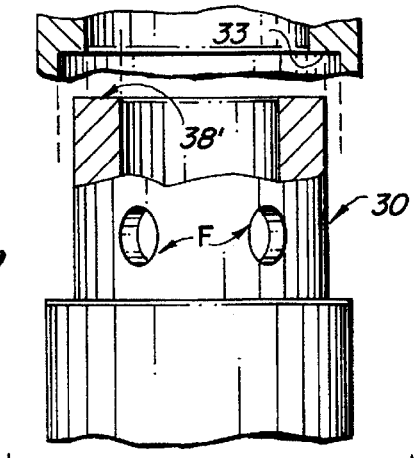
Figure 12:
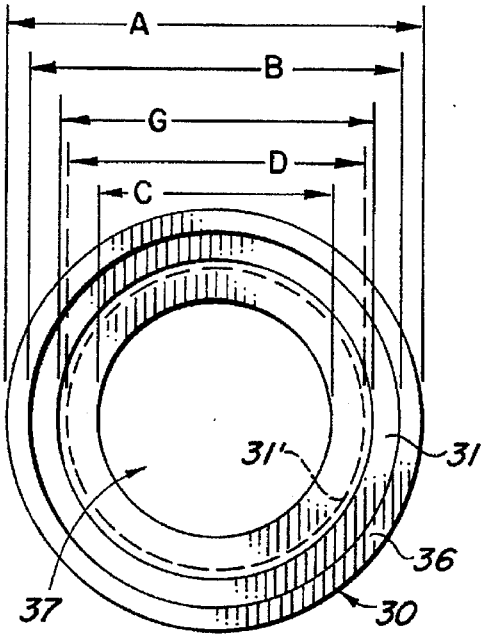
FIG. 12 of the drawings is a top view of a new control valve that forms part of this invention; and, FIG. 13 of the drawings is a top view of a prior art control valve that can be modified according to this invention; and, FIGS. 14, 15 and 16 are broken, part cross-sectional, part diagrammatical, side views showing various pump ends that are suitable for use in combination with the improved engine and valve assembly set forth in the foregoing figures.
Figure 13:
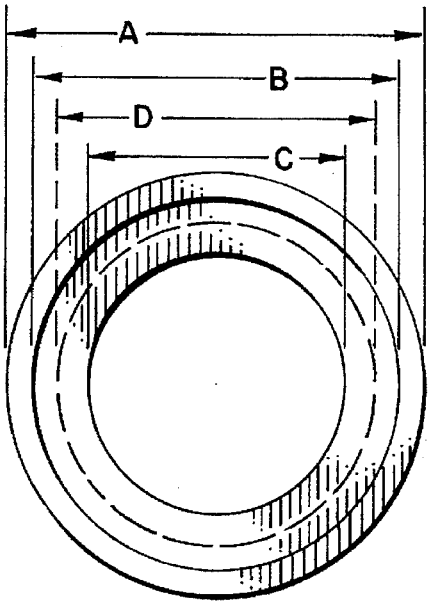
FIG. 13 (PRIOR ART)

As best shown in FIGS. 9 and 10 of the drawing, the valve assembly and stop have been modified in accordance with this invention. In FIG. 9 the valve upper stop has been modified by increasing the inside diameter of the face which adds area which is exposed to the power fluid, as noted at step 138, whereby pressure differiential across opposed ends of the valve is favorably changed according to the present invention.

In FIG. 4, the third illustrated means 3 is formed in proximity of the upper end of the control valve 30 by which the additional downhole force is effected on the uphole part of the control valve 30 is seen in greater detail in FIGS. 6, 7, 9 and 10, which illustrates additional area formed adjacent the upper end 31 of the control valve 30 respective to the lower end 33 of the stop means.

Figure 6:
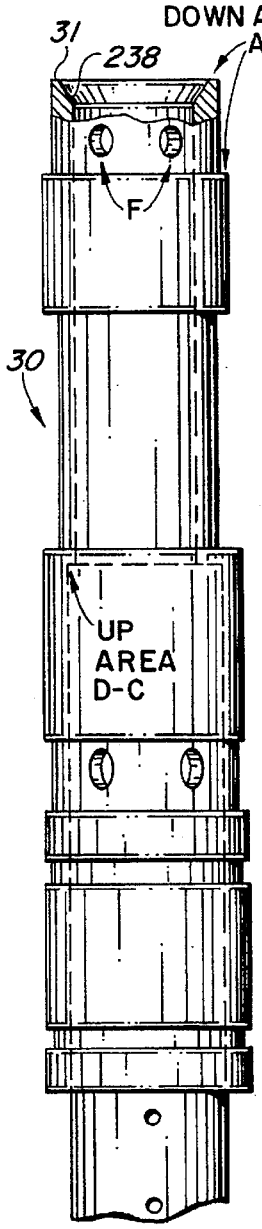
FIGS. 6 and 7 are broken, part cross-sectional, part diagrammatical, side views of various modifications of part of the apparatus of FIG. 3.

In FIG. 6, the face at the upper end of the control valve 30 is reduced in area while additional surface area is exposed to the power fluid by the formation of the illustrated conical inner surface 238, which is in the form of a frustrum of a cone, and forces the control valve to move into an alternate position of operation.

Figure 7:
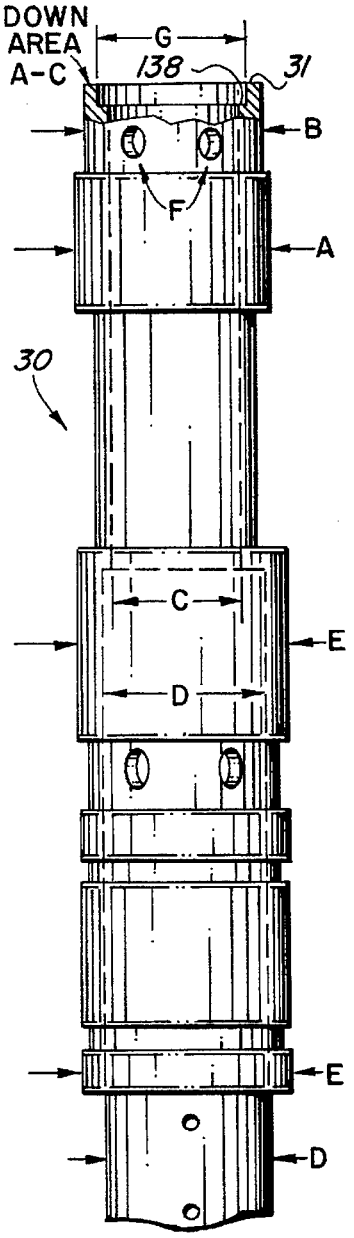

The third means 3 was previously noted in FIG. 7 by the formation of a shoulder 138 on the inside of end 31 of control valve 30. This step-like relief provides additional area that is subjected to power fluid for forcing the control valve back down.

As best shown in the FIGS. 9 and 10 of the drawing, the valve assembly and stop has been modified in accordance with the present invention. In FIG. 10 the valve top stop has been modified by increasing the inside diameter of the face which adds area to the top end of the main valve which is exposed to the power fluid, as noted at 38'. Another means whereby pressure differential across opposed ends of the valve is favorably changed according to the present invention is the provision of the illustrated step 138 formed through the top marginal end of the control valve as previously noted in conjunction with FIG. 7.

Figure 14:
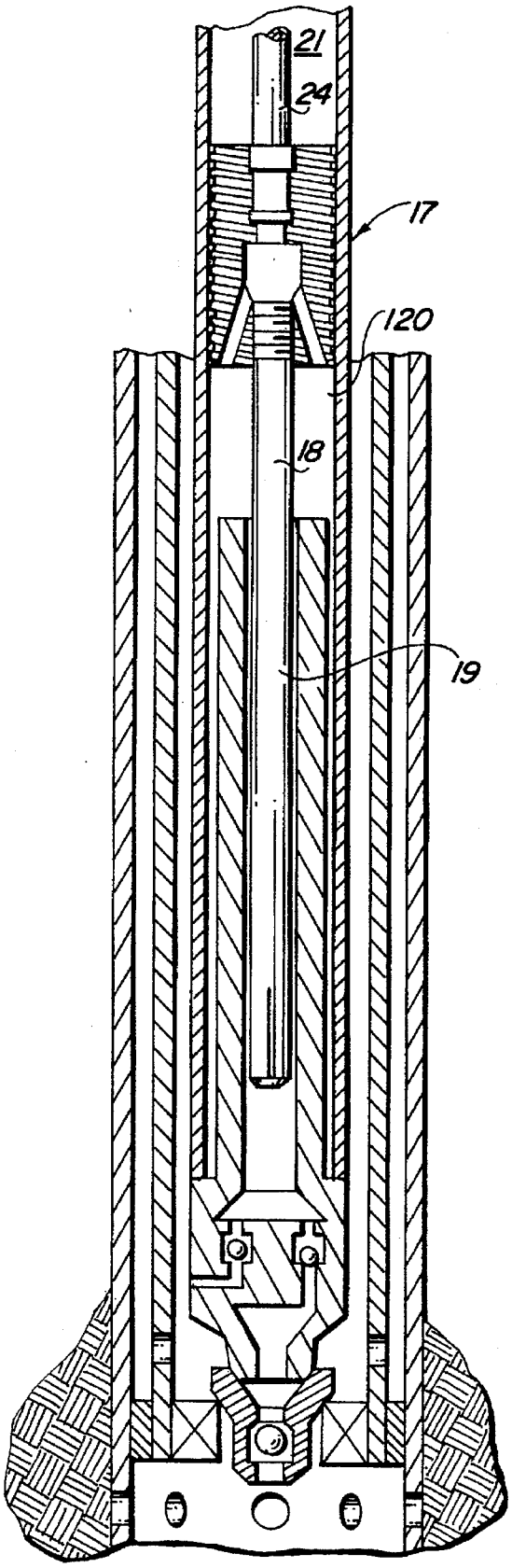
Figure 15:
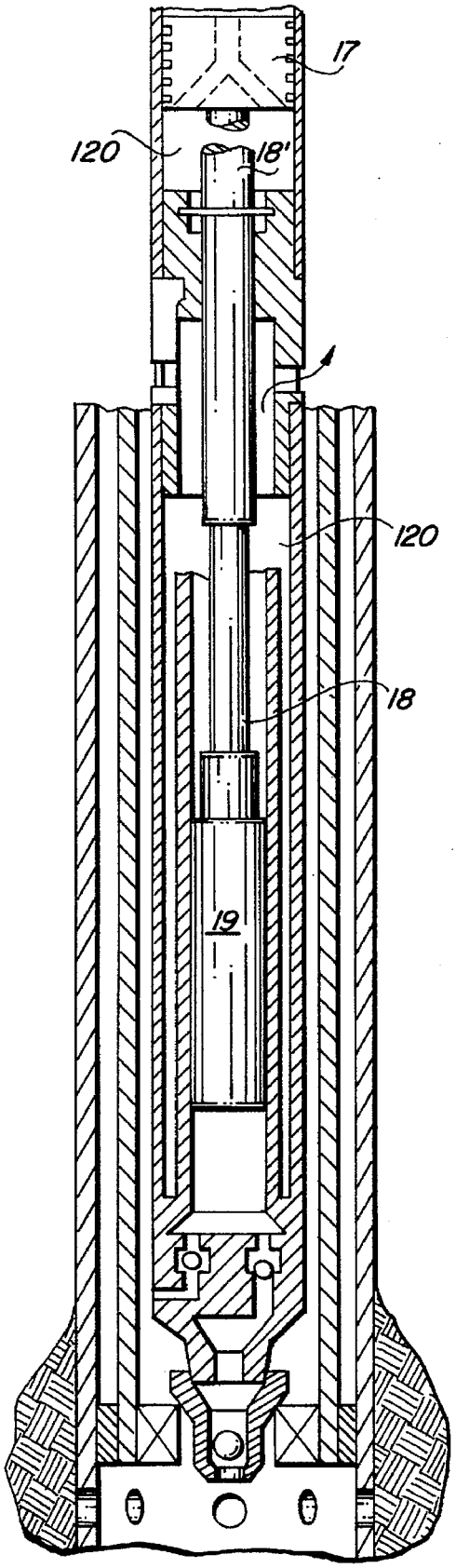
Figure 16:
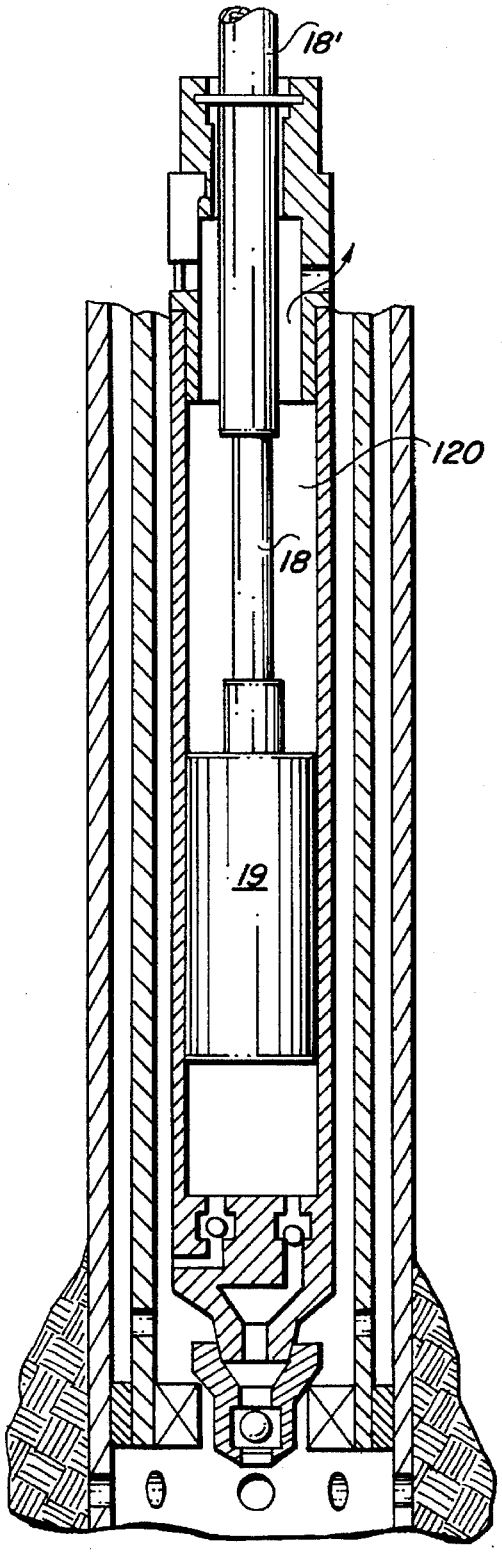

Several variations in the structure of the downhole pump that can be utilized in conjunction with the novel control valve assembly 14 of this invention are set forth in FIGS. 14, 15 and 16. FIG. 14 shows the engine piston 17 connected to a common chamber 120 which is directly in communication with both the engine and pump pistons 17 and 19. It should be noted that in FIGS. 15 and 16, a packing box is required in order to separate the engine and pump chambers from one another, and that produced fluid flows into and out of the engine balance chamber by means of ports formed in the packoff. Reference is made to the above mentioned patents for further details of the pump end of the combination, which can take on any number of different forms while remaining within the comprehension of this invention.

In FIGS. 6, 7, 12 and 13 of the drawings, the effective bearing surface, that is, the surface against which the power fluid reacts in order to stroke the control valve downhole, is seen to be the difference between the outside diameter of "A" minus the outside diameter of "B" in relation to the inside diameter of "D" minus the inside diameter of "C", and must be judiciously selected in accordance with this invention to provide a ratio of areas subjected to the pressure differiential across the valve wherein the resultant forces cause the main valve to move back downhole in response to the pressure thereacross. Otherwise, should a positive seal be formed on the top end 31 of the control valve 30 against the valve stop means 33, (A-B) area must be larger than (D-C) in order for the pressure to force the main valve down.

New oversize control valves 30 can be made for oversized control valve assembly bodies having an outside diameter large enough for the pressure to act on and force the main valve down. The correction means, such as a taper 238 on the end as shown in FIG. 6, will allow the fluid under pressure to force the control valve 30 to move down by increasing the exposed area on the top end thereof. Any means of increasing the area on the top of the control valves that is subjected to the power fluid is contemplated to be within the comprehension of this invention, including the formation of a hole or notch in the upper end of the main valve of U.S. Pat. No. 3,849,030, for example. Any of the means recited herein may be used for increasing the area at the top end of the main valve of U.S. Pat. Nos. 2,081,223 and 3,849,030 and is deemed to be covered by this patent application. Also included is the formation of any fluid passageway communicating the interior of the control valve with the exterior thereof as described above.

The control valve of this patent application may be used for a single action hydraulic pump control valve, and it also may be used in double action pump assemblies.

In operation, as the engine downstrokes, the control valve upstrokes, and upper end 31 of the control valve 30 abuts the shoulder of the upper stop 33, thereby limiting the upward movement of the valve, and as the control valve shifts down, the undercut areas 40 and 42 are too short to bleed down the area under the control valve. Therefore undercut area 44 is provided for preventing fluid from being trapped under the control valve. Undercut area, or flat 44, is longer than undercut areas 40 and 42, and connect ports 46 and 48, allowing fluid to discharge from under the control valve to the discharge 50, so that the pressure on the upper part of the control valve pushes it down from the position of FIG. 5B into the position of FIGS. 3 and 5A. Hence, flat 52 exhausts power fluid from chamber 21 up through 60, then through 49 into chamber 29 and out of port 66 of FIG. 3. When the piston 17 is up, undercut areas 40 and 42 allow power fluid to flow down into the area below the valve assembly.

Most pump engines operate such that when the control valve is down, the control rod comes down; and, when the control valve is up, the rod comes up. The pump operation of this invention is the opposite because when the control valve moves down, the control rod is coming up, and when the control valve is up the control rod is coming down.

Reference is made to my previous U.S. Pat. Nos. 3,703,926 and 5,104,296, and particularly to FIGS. 3 and 18 of U.S. Pat. No. 5,104,296, an FIGS. 2 and 3 of U.S. Pat. No. 3,703,926 for further background of this disclosure. Reference is also made to Coberly, U.S. Pat. No. 2,081,223, and McArthur, U.S. Pat. No. 3,849,030, for additional background.

It should now be apparent that this invention is to a control valve assembly 14 which controls the flow of power fluid to an engine piston 17 which in turn reciprocates a pump piston 19. As shown in the drawings, this concept provides a new valve assembly 14 for an engine 15, and is particularly adapted for use in the pump disclosed in U.S. Pat. No. 3,703,926, for example. A few of the benefits that are derived by combining my new engine with several old pumps is that the valve rod or control rod can be made much larger in diameter thereby increasing the operating speed as well as the rate of produced fluid/per stroke, all of which represents unexpected improvements in operation of the pump engine end. Those skilled in the art, having fully digested this disclosure, will appreciate that my improved hydraulic engine can advantageously be incorporated into numerous downhole pump ends other than the above examples, which are cited as examples only.

In FIG. 3, annular passageway 37 receives power fluid at PF. The flow of power fluid, with the pump as shown in FIG. 3, cannot continue past chamber 37 (except into the hollow control rod), and along its ultimate path until the two annulus 54, 56 are aligned along a flow path as a consequence of the control rod being upstroked, noting that annulus 37 can be connected by flat 40 to annulus 54; and, 54 to 56 by flat 42.

With the engine control valve assembly 14 in the position of FIG. 3, power fluid enters the upper end of the control rod and flows axially through the engine until it reaches engine piston 17 where it exits through piston ports at 58 into the expansion chamber found under the engine piston, thereby forcing the piston to upstroke. At this time the fluid above the engine piston exits the engine end of the pump assembly along the following path: from chamber 21, through port 60 into annulus 49, through port 62 of the valve into annulus 29 and back through the port of the valve into port 66 where the fluid is free to admix with produced fluid. The engine piston downstrokes when the force exerted by the power fluid is removed from the lower face 22 of the engine piston 17, due to the hydrostatic head effected along the same passageway leading to and from chamber 21, through port 60 into annulus 49, through port 62 of the control valve into annulus 29 and back through port or small passageway 64 of the valve into port 66.

As the engine upstrokes, the valve is down, and as the engine piston moves the control rod 24 up, it brings the undercut areas 40 and 42 into position to form the illustrated flow paths and thereby provide for the flow of power fluid to continue from annuluar chamber 21 to port 46, the latter being formed though the lower end of the fixed control sleeve, where power fluid flow is now effected at lower terminal end 32' of the control valve, which lifts the control valve 30 due to the pressure and area differences at the opposed ends of the valve element. This shifts the valve into the opposite configuration seen in FIG. 5B.

I claim:

1. A downhole pump assembly for producing a formation located downhole in a borehole; said pump assembly comprising:

an improved hydraulically actuated engine connected to actuate a downhole pump; said engine having an axial passageway within which an engine piston is reciprocatingly received, said engine piston has opposed faces; a control valve reciprocatingly received within the engine axial passageway and connected to supply power fluid to one face of the engine piston to thereby stroke the engine piston which in turn strokes the downhole pump; said control valve has an upper end opposed to a lower end thereof;

stop means in said axial passageway for abuttingly engaging said upper end of said control valve;

and means adjacent said upper end of said control valve by which power fluid effects a downhole force on said control valve which is greater respective to any opposed uphole force effected thereon and thereby moves said control valve downhole following each uphole stroke due to the differential in the opposed uphole and downhole forces.

2. The improvement of claim 1 wherein said control valve has a marginal upper end, an interior, and an exterior; said means adjacent said upper end of said control valve by which a downhole force is effected on said control valve is a flow passageway formed adjacent the upper end of the control valve and extending from the interior of said control valve to the exterior thereof to equalize the pressure across the upper end of the control valve and thereby expose additional area of the control valve to the power fluid and thereby provides the recited differential in opposed forces and moves said control valve downhole following each uphole stroke thereof.

3. The improvement of claim 2 wherein said flow passageway is formed at an interface formed between the upper end of the control valve and stop means and adjacent the upper end of the control valve and includes an increased area on the inside diameter of the upper marginal end of said control valve, and said flow passageway is formed at the upper terminal end of the control valve whereby the effective area of the upper end of the control valve which is contacted by the power fluid is increased to thereby increase the downhole force that is imposed on said control valve when the upper end of the control valve abuttingly engages the stop means.

4. The improvement of claim 1 wherein said upper end of said control valve has an upwardly opening interior that terminates in a circumferientially extending end, and said means adjacent said upper end of said control valve by which a downhole force is effected on said control valve includes an increased area at a location within said control valve that is exposed to the power fluid and which is formed in spaced relationship and inwardly of the circumferentially extending upper end of the control valve at a location that is inside of the stop means when the stop means abuttingly engages the upper end of the control valve, whereby, when the control valve abuttingly engages the stop means therefor, and said flow passageway is formed at the upper terminal end of the control valve, the exposed area of the upper end of the control valve that is contacted by the power fluid provides a downhole force that is greater than the uphole force imposed on the opposed end of said control valve.

5. The improvement of claim 1 wherein said control valve has an interior and an exterior, said means adjacent said upper end of said control valve by which a downhole force is effected on said control valve includes a plurality of cutouts that form a flow passageway adjacent the upper end of the control valve and extend from the interior of the control valve to the exterior thereof to equalize the pressure across the upper end of the control valve when the control valve abuts the stop means therefor to thereby decrease the area on the upper end of the control valve which contacts the stop while at the same time increases the area on the control valve which contacts power fluid to thereby force the control valve to reciprocate downhole following each uphole stroke.

6. The improvement of claim 1 wherein said control valve has an interior and an exterior, said means on said upper end of said control valve by which a downhole force is effected on said control valve is a flow passageway formed adjacent the upper end of the control valve and extending from the interior of the control valve to the exterior thereof to equalize the pressure across the upper end of the control valve and thereby provide an increased force as may be required for the control valve to stroke downhole after engaging the stop means.

7. The improvement of claim 1 wherein said means on said upper end of said control valve by which a downhole force is effected on said control valve includes an enlargement adjacent said upper end that provides additional surface area that is subjected to power fluid to provide a downhole force that is greater than the corresponding uphole force effected on the lower end of the control valve.

8. A method of operating a hydraulically actuated engine for a downhole pump of the type having a hydraulically actuated engine connected to actuate a downhole pump apparatus;

wherein said engine has an axial passageway within which an engine piston is reciprocatingly received, with said engine piston having opposed faces, and a control valve reciprocatingly received within the engine axial passageway and connected to supply power fluid to one face of the engine piston to thereby stroke the engine piston which in turn strokes the downhole pump; and with said control valve having and upper end opposed to a lower end thereof; and stop means at opposed ends of said axial passageway for abuttingly engaging the opposed ends of said control valve; comprising the steps of:

providing a downhole force in close proximity of said upper end of said control valve; said downhole force being exerted on the upper end of said control valve when the upper end of the control valve is abuttingly engaged with the stop therefor, said downhole force being greater respective to the uphole force thereon and thereby moves said control valve downhole following each uphole stroke, forming an upwardly opening interior within the upper marginal end of the control valve; forming a circumferentially extending face at the upper terminal end of the control rod for abuttingly engaging the stop means and thereby forming an interface therebetween that separates the interior of the control rod from the exterior thereof;

effecting the downhole force on the upper end of said control rod by forming a flow passageway adjacent the upper terminal end of the control valve and extending the passageway from the interior of the control valve to the exterior thereof to equalize the power fluid pressure across the upper end thereof and thereby provide additional area by which the control valve is forced to move downhole into an alternate position.

9. The method of claim 8 wherein said flow passage is provided by the following steps: forming said flow passageway adjacent an interface formed between the upper end of the control valve and the stop therefor and extending the passageway from the interior of the control valve to the exterior thereof at a location spaced from said interface; equalizing the pressure across the upper end of the control valve by flowing power fluid through said passageway and thereby provide a downhole force on the control valve which is greater respective to the uphole force thereon and thereby move said control valve downhole following each uphole stroke.

10. The method of claim 9 wherein said downhole force effected on said control valve is achieved according to the additional step of: forming an enlargement within said upper end that provides a surface area subjected to power fluid that is greater than the corresponding area at the lower end of the control valve.

11. The method of claim 8 wherein said downhole force that is effected on said upper end of said control valve is achieved by the following additional step:

forming an enlargement adjacent to and within said upper end and in spaced relationship respective to said terminal end that provides a surface area that can be subjected to power fluid by flowing power fluid through said passageway to provide a force that is greater than the force provided by the corresponding area on the lower end of the control valve.

12. The method of claim 8 wherein said downhole force on said upper end of said control valve by which a downhole force is effected thereon includes the following step:

forming an enlargement on said upper end that provides a surface area subjected to power fluid that is greater than the corresponding area located on the lower end of the control valve.

13. The method of claim 8 wherein said downhole force effected on said upper end of said control valve includes the steps of:

forming a flow passageway adjacent the upper end of the control valve and extending said passageway to communicate the interior of the valve with the exterior thereof whereby flow occurs from the interior of the control valve to the exterior thereof to thereby equalize the pressure across the upper marginal end of the control valve and thereby apply a force to move downhole into an alternate position due to the differential in the control valve pressure effected on opposed ends of the control valve;

and forming an enlargement adjacent said upper end that provides a surface area subjected to power fluid that is greater than the corresponding area at the lower end of the control valve.

14. In a downhole pump assembly of the type having a hydraulically actuated engine connected to stroke a production pump uphole and downhole, said engine having a power fluid inlet and a spent power fluid outlet; said production pump having a formation fluid inlet and a produced fluid outlet;

said engine having an improved valve assembly connected to supply power fluid to the engine and to exhaust spent power fluid therefrom; said valve assembly comprising a control valve reciprocatingly received within said valve assembly and having opposed ends which abuttingly engages an upper and a lower stop means, respectively, at the end of each uphole and downhole stroke, respectively, as the control valve shifts from one to an alternate position of operation in response to reciprocation of the engine piston; said control valve having an interior and an exterior;

means on said upper end of said control valve by which a downhole force is effected on said control valve, including a flow passageway adjacent the upper end of the control valve and extending from the interior to the exterior of the control valve and thereby communicating the interior of the control valve with the exterior thereof whereby power fluid flow occurs between the interior of the control valve and the exterior thereof to thereby equalize the pressure across the upper marginal end of the control valve and thereby contact the entire upper end of the control valve with power fluid to force the control valve to move downhole into an alternate position due to the differential in pressure effected on opposed ends of the control valve.

15. The downhole pump assembly of claim 14 wherein said means on said upper end of said control valve by which a downhole force is effected on said control valve is a relatively large surface area compared to the surface area of the opposed end of the control valve; said means on said upper end is located on the interior of the control valve that is in contact with the operating fluid to force the control valve to move from one to the other alternate positions of operation.

16. The downhole pump assembly of claim 15 wherein said means on said upper end of said control valve by which a downhole force is effected on said control valve includes a flow passageway formed adjacent the upper end of the control valve and extending from the interior of the control valve to the exterior thereof to equalize the pressure across the upper end and thereby force the valve to move into an alternate position of operation.

17. The downhole pump assembly of claim 14 wherein said control valve has an interior and an exterior; means on said upper end of said control valve by which a downhole force is effected on said control valve includes a flow passageway formed between the interface at the upper end of the control valve and the stop therefor, said passageway extends from the interior of the control valve to the exterior thereof to equalize the pressure across the upper end of the control valve; the upper terminal end of the control valve abuts the stop means therefor whereupon said passageway exposes the inside area of the upper end to the power fluid and thereby unbalance the force differential on the valve to move the control valve into an alternate position of operation after each upstroke thereof.

18. The downhole pump assembly of claim 14 wherein said means on said upper end of said control valve by which a downhole force is effected on said control valve includes a plurality of cutouts that form a flow passageway adjacent the upper end of the control valve that extends from the interior of the control valve to the exterior thereof to equalize the pressure across the upper end of the control valve when the control valve abuts the stop therefor; and further including an increased inside diameter formed at the marginal upper end of the control valve which decreases the area of the control valve which contacts the stop while at the same time increases the inner area of the control valve which is subjected to power fluid to thereby provide an unbalanced force across the engine control valve which forces the control valve to reciprocate downhole following each uphole stroke.

19. The downhole pump assembly of claim 17 wherein said flow passageway formed adjacent the upper end of the control valve is a plurality of apertured slots formed at the upper marginal end of the control valve and communicating the interior of the control valve to the exterior thereof to equalize the pressure across the upper end;

and an increased pressure differential is effected across the control valve which is greater respective to the uphole force thereon and thereby moves said control valve downhole following each uphole stroke by the provision of an enlargement formed on the upper end of the control valve which is greater in diameter respective to the stop means whereby, when the control valve is seated against the stop means, the exposed area on the enlargement of the control valve is contacted by power fluid to provide a downhole force in excess of the uphole force on the control valve, whereupon the control valve is forced into the alternate position.

* * * * *